United States Patent [19]

Merz

[11] 4,002,442

[45] Jan. 11, 1977

[54] EQUALIZING TANK FOR THE VOLUME EQUALIZATION AND THE AIR SEPARATION OF A LIQUID HEAT CARRIER FLOWING THROUGH A CIRCULATORY SYSTEM

[75] Inventor: Josef Merz, Ostfildern, Germany

[73] Assignee: Daimler-Benz Aktiengesellschaft, Germany

[22] Filed: Apr. 22, 1975

[21] Appl. No.: 570,993

[52] U.S. Cl. ..... 55/309; 123/41.54; 165/114

[51] Int. Cl.[2] ..... B01D 46/42

[58] Field of Search ..... 55/309, 159, 186; 123/41.54; 165/114

[56] References Cited

UNITED STATES PATENTS

| | | | |
|---|---|---|---|
| 1,680,641 | 8/1928 | Salerni | 165/114 |
| 3,282,333 | 11/1966 | Jensen | 55/159 |
| 3,455,377 | 7/1969 | Hayes | 165/110 |

*Primary Examiner*—Bernard Nozick
*Attorney, Agent, or Firm*—Craig & Antonelli

[57] ABSTRACT

Equalizing and air separation tank structure for accommodating separation of air from a liquid heat carrier flowing through a cooling system for an internal combustion engine cooling space. A pair of separation chambers are provided in series connection with one another and one above the other, both having separate vents opening to an air chamber space arranged thereabove. The upper separation chamber includes an inlet opening for a portion of the flow through the circulatory system and the lower separation chamber includes an outlet for such flow, which outlet opens adjacent a main flow outlet which accommodates passage of the remaining portion of the coolant flow in bypassing relationship to the separation chambers. The main flow inlet to the tank opens into a main flow chamber, which also includes a separate bypass vent leading to the air chamber above the separation chambers. The separation chambers and main flow chamber are formed by a pair of sheet metal partition walls, one being of L-shaped configuration and the other being of U-shaped configuration.

39 Claims, 3 Drawing Figures

EQUALIZING TANK FOR THE VOLUME EQUALIZATION AND THE AIR SEPARATION OF A LIQUID HEAT CARRIER FLOWING THROUGH A CIRCULATORY SYSTEM

BACKGROUND AND SUMMARY OF THE INVENTION

The present invention relates to equalizing tank apparatus for volume equalization and air separation of a liquid heat carrier flowing through a circulatory system, especially for a circulatory system for a liquid-cooled internal combustion engine. More particularly, the present invention is directed to an improved tank apparatus of the type including a lower main-flow chamber arranged at the bottom of the tank and provided with a main-flow entrance and main-flow exit connected in series with the coolant circulatory system as well as also a secondary or separation-flow chamber arrangement including a secondary-flow entrance into an upper separation chamber and a secondary-flow exit from the separation chamber for the connection into the main-flow stream. In tank constructions of this type, vent openings are provided between an air chamber space and the top of the separation chamber for accommodating escape of entrapped air in that portion of the flow of coolant through the separation chamber.

U. S. Pat. No. 3,455,377 discloses an equalizing tank of the above-mentioned type. Such equalizing tanks operate such that a portion of the cooling water main flow is discharged as a secondary flow into the separation chamber and is slowed down there in order to accommodate separation of the air particles entrenched in the secondary flow, which air particles then collect in the air chamber of the equalizing tank above the separation chamber. The velocity decrease in a separation chamber is obtained because the flow cross-sections of the secondary-flow entrance and secondary-flow exit are very small in relation to the cross-section of the separation chamber. Since the flow cross-section of the separation chamber, however is usually constructed relatively narrow on account of avialable space, the secondary flow quantity must be very small in order to maintain the low flow velocity in the separation chamber. However, with such a small secondary flow, the danger exists that with the accumulation of larger air quantities in the main flow, the air particles must pass a number of times through the cooling circuit before they arrive at the separation chamber arranged in the secondary flow.

The present invention contemplates overcoming the above-discussed disadvantages by providing an improved equalizing tank of the type mentioned above in such a way that even with a larger accumulation of air quantities, an effective separation of the air particles is attained.

According to a first important feature of the present invention, a separation chamber arrangement is provided which includes at least two secondary-flow chambers interconnected in series and each having a vent connection discharging into the air chamber of the separation chamber arrangement. The secondary-flow chamber arranged at one end of the series connection is provided with the secondary flow entrance and the secondary flow chamber arranged at the other end of the series connection is provided with the secondary flow exit. The secondary flow chambers connected in series form a multitude of vent places so that the system can be operated with higher flow velocities in the secondary flow, whereby the total cross-section of these secondary flow chambers is constructed so as not to be considerably larger than the cross-section of the corresponding single separation chamber in known equalizing tanks.

A second important feature of the invention which aides in overcoming the above-discussed disadvantages includes the provision of a vent bypass connection leading from the main flow chamber in bypassing relationship to the secondary flow and discharging into the air chamber of the separation chamber arrangement. By this arrangement, a vent place in the main flow chamber is created which is independent of the flow velocities in the secondary flow. This arrangement provides for the separation of air particles which have not entered into the secondary flow and which, in the above-discussed previously known equalizing tanks, are forced to pass through further circulation cycles until diverted into the secondary flow through the separation chamber.

In preferred embodiments of the invention, the opening of the vent bypass connection to the main-flow chamber is arranged geodetically above the opening of the secondary-flow exit discharging into the main flow chamber such that any air particles not separated in the secondary flow and discharging into the main flow chamber can be removed from the main flow chamber via the vent bypass connection.

In order to safely catch the air particles entering the main flow chamber by way of the main flow inlet or entrance, preferred embodiments of the invention provide that the opening of the vent bypass connection into the main flow chamber lies above the flow range between the main flow entrance and the main flow exit.

In order to diminish the danger that the flow in the secondary flow entrance drags along air particles collected in the air chamber, preferred embodiments of the invention provide that the secondary-flow entrance opening into the secondary flow chamber and the opening of the vent connection of this secondary flow chamber which discharges into the air chamber are displaced horizontally with respect to one another.

In preferred embodiments of the invention, a filling connection for the tank is disposed in a range above the chamber wall of the secondary flow chamber provided with the secondary flow entrance, which chamber wall covers the opening of the secondary flow entrance discharging into the secondary flow chamber. In this manner, during filling of the equalizing tank via the filling connection, it is prevented that the rising air from the secondary flow chamber and the liquid particles of the in-flowing liquid flow counter to each other.

In order to accommodate a number of secondary flow chambers within a small space, the present invention contemplates arranging the chambers such that the bulge of one secondary flow chamber reaches underneath an adjacent secondary flow chamber and also forms the secondary flow connection between such chambers.

Although deflections of the secondary flow are themselves favorable for the improvement of the separation process, they nevertheless result in pressure losses. In order to reduce such pressure losses, preferred embodiments of the invention provide that the opening of the secondary flow entrance discharging into the secondary flow chamber is positioned geodetically above the exit for the same secondary flow chamber. For this same purpose, preferred embodiments of the invention provide that the opening of the secondary flow exit from the endmost secondary flow chamber lies geodetically below the opening of the secondary flow connection discharging into this same endmost secondary flow chamber.

In a structurally simple and, therefore, advantageous embodiment of the equalizing tank of the present invention, the secondary flow chamber having the secondary flow entrance is enclosed by an essentially U-shaped partition wall, the wall shanks of which partition wall are disposed at an angle other than 90° in relation to the essentially vertically extending wall web. In this embodiment, the upper wall shank shields the secondary flow entrance against the filling connection whereas the lower wall shank, which continuously ascends from the secondary flow exit to the vent bypass connection, forms the upper closing wall of the main flow chamber. The U-shaped chamber wall preferably consists of a simple separation sheet-iron. This embodiment of the invention preferably also includes an L-shaped partition wall enclosing the side of the secondary flow chamber having the secondary flow entrance which is opposite the U-shaped partition wall. One of the wall shanks of the L-shaped partition wall extends essentially vertically and forms an angle other than 90° in relation to the other wall shank. The wall shank of the L-shaped partition wall which is slanted to the vertical exhibits, in a simple manner, a bulge of the adjacent secondary flow chamber. Also, the L-shaped chamber wall is preferably simple sheet-iron or other metal partition.

A special advantage of the just-described preferred embodiment of the invention resides in that, through the arrangement of only two partition walls in the equalizing tank, a main flow chamber, two secondary flow chambers, a vent bypass connection of the main flow chamber, as well as an upper air chamber are formed.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE DRAWINGS

Figure 1:
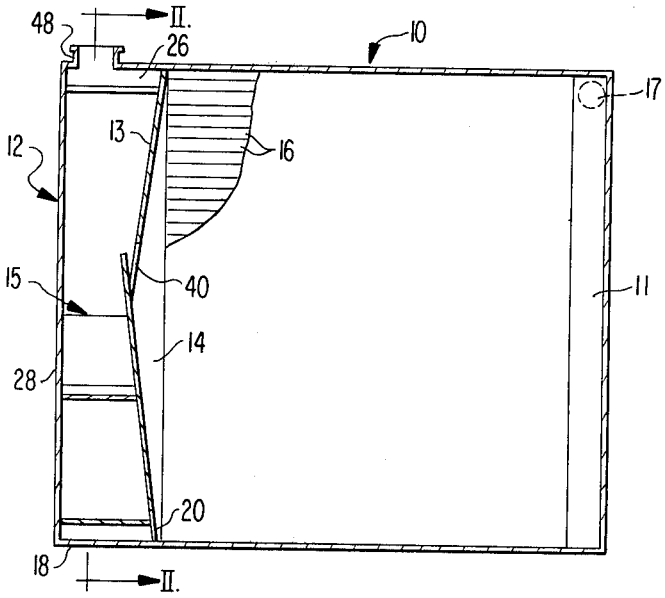
FIG. 1 is a schematic cross-sectional view taken along line I—I of FIG. 2 which shows a cross-flow cooler with air separation tank apparatus constructed in accordance with the present invention.

Throughout the following description, like reference numerals are used throughout the various views to designate like structure.

Cross-flow cooler 10 is provided on one side thereof with an inlet-side water box 11 and at the other side thereof with a discharge-side water box 12. The water box 12 is subdivided by a roof-like partition wall 13 into a collecting chamber 14 and a box-like equalization tank 15. The water box 11 and the collecting chamber 14 are connected with each other by transversely extending cooling water paths 16. The cooling water is supplied to the water box 11 through an upper supply connection 17, flows through the cooling water paths 16 and discharges subsequently into the collecting chamber 14.

At the bottom 18 of the equalizing tank 15, a main flow or main stream chamber 19 is arranged which is in communication with the collecting chamber 14 by way of a lower opening 20 in the partition wall 13 so that the cooling water enters the main flow chamber 19 from the collecting chamber 14 via this opening 20. The return connection for the water box 12 opens into the main stream chamber 19 to accommodate discharge of the cooling water from the main stream chamber 19.

A U-shaped partition wall 22 is inserted into the equalizing tank 15 and includes a web plate 23 which extends parallel to and at a distance from the rear front wall 24 of the water box 12 to thereby form a vent bypass connection 25 between the main flow chamber 19 and air chamber 26, which air chamber 26 is formed below the cover wall 27 of the equalizing tank 15 and above the shank portion 29 of the U-shaped wall 22. The partition wall 23 is tightly connected with the partition wall 13 as well as also with the side wall 28 of the water box 12. The spread shank walls 29 and 30 of the U-shaped partition wall 23 form an open U in relation to the front wall 31 of the water box 12 and are arranged with their free ends each at a distance to the front wall 31 as well as also to the cover wall 27, respectively the bottom wall 18.

Further, a second L-shaped partition wall 32 is inserted into the equalizing tank 15 and is tightly connected with the partition wall 13 as well as also with the side wall 28. One shank wall 33 of the partition wall 32 extends parallel to and spaced from front wall 31. This shank wall 33 is also spaced from the shank wall 29. The other angularly inclined shank wall 34 of the partition wall 32 subdivides the tank chamber formed by the front wall 31 and the other partition wall 22 into two secondary or separation flow chambers 35 and 36. These chambers 35 and 36 are connected with one another through a secondary flow connection 37 formed by a spacing of the free wall end of the shank wall 34 and the shank wall 30. Also, front wall 31 and shank wall 33 form, on the one hand, a vent connection 38 to the air chamber 26 for the secondary flow chamber 36, and on the other hand, shank wall 33 and shank wall 29 form a vent connection 39 to the air chamber 26 for the secondary flow chamber 35.

Figure 2:
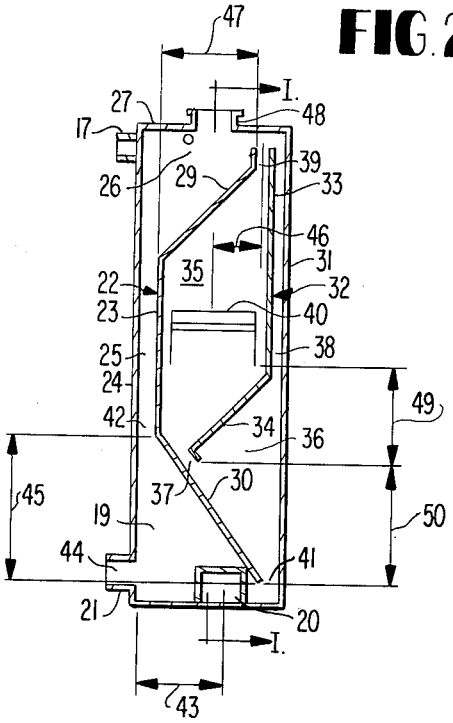
FIG. 2 is a schematic cross-sectional view along line II—II of FIG. 1.
Figure 3:
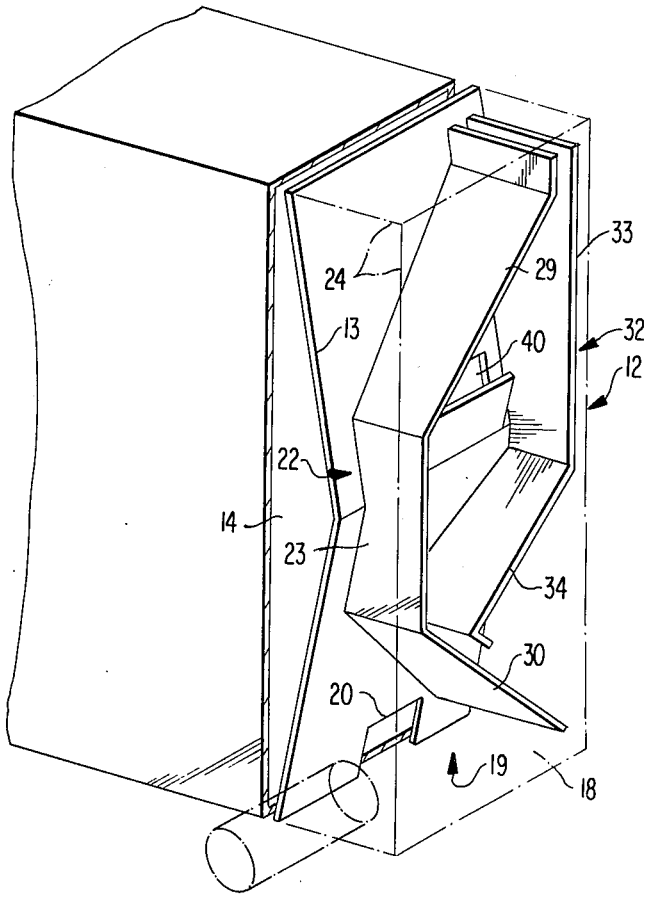
FIG. 3 is a schematic perspective depicting the interior elements of the air separation tank apparatus of FIG. 1.

An opening 40 is provided in the partition wall 13 which connects the collecting chamber 14 with the secondary flow chamber 35 and thereby forms the secondary or separation flow entrance of the equalizing tank. Through the free gap between the shank wall 30 and the front wall 31 and bottom wall 18 (see FIG. 2,) a secondary flow discharge 41 is formed which connects the secondary flow chamber 36 with the main flow chamber 19. During operation of the apparatus, a part quantity of the cooling water flow in the collecting chamber 14 is branched off through the opening 40 and is brought, as secondary or separation flow, through the secondary flow chambers 35 and 36 and then via opening 41 into the main flow chamber 19 where it is again combined with the cooling water main flow. The cooling water main flow enters main flow chamber 19 through opening 20, which opening 20 is in bypassing relationship to the flow through the secondary flow opening 40 and the secondary separation chambers 35 and 36. In the secondary flow chambers 35 and 36, air is separated from the secondary flow which is passed into the air chamber 26 by means of the respective vent connections 39 and 38.

The vent bypass connection 25 is an additional venting place for accommodating air separation from the main flow passing from the opening 20 to the return connection 21 to respective opposite sides of the main flow chamber 19. To accommodate this air separation, vent connection 25 has its opening 42 to the main flow chamber 19 arranged above the range 43 where the opening 44 of the return connection 21 and the main flow inlet 20 are located. Opening 42 is disposed so as to exhibit a geodetical head 45 with respect to the secondary flow discharge 41 so that also air particles entering the main flow chamber from the secondary flow can be separated through the vent bypass connection 25 into the air chamber 26.

The vent connection 39 of the secondary flow chamber 35 is displaced horizontally by a distance 46 in relation to the axis of the opening 40 so that it is avoided that, by the flow through opening 40, air particles are carried along from the air chamber 26 into the secondary flow. The filling connection 48 arranged at the cover wall 27 is disposed in the range 47 above the shank wall 29 covering opening 40 so that the filling flow is kept away from opening 40.

The shank walls 30 and 34 define a bulge (note largest cross-section of chamber 36 formed at left end of shank wall 34) which is disposed underneath the secondary flow chamber 35 with a consequent tiered arrangement of the secondary flow chambers 35 and 36 demanding a relatively narrow total container cross-section while optimizing the cross-section of the individual secondary flow chambers.

A reversal or change in direction of the secondary flow as it passes from opening 40 through secondary chambers 35 and into secondary chambers 36 is assured by the provision of the secondary flow connection 37 at the broadest place of the bulge 30, 34. As a result of the level difference 49 between the opening 40 and the secondary flow connection 37, the pressure losses caused by the flow reversal are minimal.

In a manner as described in the preceding paragraph, the secondary chamber 36 also provides for a forced flow diversion or reversal due to the horizontal displacement of flow discharge 41 with respect to connection 37. Also, geodetic head 50 between the secondary flow connection 37 and the secondary flow exit 41 assures a minimization of the pressure losses caused by such flow diversion or reversal.

The steadily slanted course of the shank walls 29, 30 and 34, as well as the undercutting-free construction of the web plate 23 and the wall shank 33 avoid the formation of air sacks or pockets in the equalizing tank.

While I have shown and described one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Equalizing tank apparatus for volume equalization and air separation of a liquid heat carrier flowing through a circulating system, especially for a circulatory system for combustion engine cooling spaces and the like; said tank apparatus comprising:

a tank housing, separation chamber means arranged in said housing with a separation flow entrance leading from a first part of the circulatory system and a separation flow exit leading to a second part of the circulatory system, air chamber means arranged above said separation chamber means, separation chamber vent means coupling said air chamber means with said separation chamber means for accommodating escape of entrapped air from the liquid flowing through said separation chamber means to said air chamber means, and a main flow chamber arranged in a lower part of said tank housing and separate from said separation chamber means, said main flow chamber having a main flow exit leading to said second part of the circulatory system and a main flow entrance leading into said main flow chamber from said first part of the circulatory system in such a manner that flow through said main flow entrance is separate from the flow through said separation chamber means, said separation chamber means being constructed and arranged to form liquid-air separating means and including a plurality of separate separation chambers connected in series with one another with said separation flow entrance opening into the first of said separation chambers and said separation flow exit being provided at the last of said separation chambers in said series connection for permitting flow to said second part of the circulatory system, said vent means including separate vent connections leading from said air chamber means to each of the respective separation chambers.

2. Apparatus according to claim 1, wherein said separation flow exit opening is disposed below the flow connection opening between said last of said separation chambers and the next adjacent chamber thereto.

3. Apparatus according to claim 1, wherein said last of said separation chambers is bounded in part by an L-shaped partition wall having an essentially vertical leg portion and an arm portion extending at an angle of greater than 90° with respect to said leg portion.

4. Apparatus according to claim 1, further comprising a vent bypass connection leading from said air chamber means to said main flow chamber in bypassing relationship to said vent means for accommodating escape of entrapped air from the liquid flowing through said main flow chamber to said air chamber means.

5. Apparatus according to claim 4, wherein said vent bypass connection opens into said main flow chamber at a position above the level of both said main flow entrance and main flow exit.

6. Apparatus according to claim 5, wherein a laterally protruding bulge portion of one of said separation chambers extends underneath an adjacent separation chamber, and wherein a flow connection between said last-mentioned separation chambers is formed at said bulge portion.

7. Apparatus according to claim 5, wherein said separation flow entrance opening lies above the flow outlet from said first of said separation chambers to the next adjacent separation chamber.

8. Apparatus according to claim 4, wherein said separation flow entrance is spaced horizontally with respect to the vent connection leading to the first of said separation chambers.

9. Apparatus according to claim 1, wherein said separation flow entrance is disposed higher than said separation flow exit.

10. Apparatus according to claim 9, wherein said separation flow exit opens into said main flow chamber adjacent said main flow entrance.

11. Apparatus according to claim 10, wherein all of said separation chambers are disposed higher than said main flow chamber.

12. Apparatus according to claim 11, further comprising a vent bypass connection leading from said air chamber means to said main flow chamber in bypassing relationship to said vent means for accommodating escape of entrapped air from the liquid flowing through said main flow chamber.

13. Apparatus according to claim 12, wherein said separation flow exit opening is disposed below the flow connection opening between said last of said separation chambers and the next adjacent chamber thereto.

14. Apparatus according to claim 12, wherein said separation flow entrance opening lies above the flow outlet from said first of said separation chambers to the next adjacent separation chamber.

15. Apparatus according to claim 12, wherein a laterally protruding bulge portion of one of said separation chambers extends underneath an adjacent separation chamber, and wherein a flow connection between said last-mentioned separation chambers is formed at said bulge portion.

16. Apparatus according to claim 12, wherein said vent bypass connection opens into said main flow chamber at a position above the opening of said separation flow exit into said main flow chamber.

17. Apparatus according to claim 16, wherein said vent bypass connection opens into said main flow chamber at a position above the level of both said main flow entrance and main flow exit.

18. Apparatus according to claim 17, wherein said separation flow entrance is spaced horizontally with respect to the vent connection leading to the first of said separation chambers.

19. Apparatus according to claim 17, further comprising a filling connection opening downwardly into said air chamber means for accommodating addition of liquid to the circulatory system, wherein said filling connection is disposed above an upper wall boundary of said first separation chamber whereby said upper wall boundary prevents liquid supplied through said filling connection from flowing directly into said first separation chamber.

20. Apparatus according to claim 1, wherein said separation flow entrance is spaced horizontally with respect to the vent connection leading to the first of said separation chambers.

21. Apparatus according to claim 20, further comprising a filling connection opening downwardly into said air chamber means for accommodating addition of liquid to the circulatory system, wherein said filling connection is disposed above an upper wall boundary of said first separation chamber whereby said upper wall boundary prevents liquid supplied through said filling connection from flowing directly into said first separation chamber.

22. Apparatus according to claim 1, further comprising a filling connection opening downwardly into said air chamber means for accommodating addition of liquid to the circulatory system, wherein said filling connection is disposed above an upper wall boundary of said first separation chamber whereby said upper wall boundary prevents liquid supplied throuh said filling connection from flowing directly into said first separation chamber.

23. Apparatus according to claim 22, wherein a laterally protruding bulge portion of one of said separation chambers extends underneath an adjacent separation chamber, and wherein a flow connection between said last-mentioned separation chambers is formed at said bulge portion.

24. Apparatus according to claim 1, wherein a laterally protruding bulge portion of one of said separation chambers extends underneath an adjacent separation chamber, and wherein a flow connection between said last-mentioned separation chambers is formed at said bulge portion.

25. Apparatus according to claim 24, wherein said separation flow entrance opening lies above the flow outlet from said first of said separation chambers to the next adjacent separation chamber.

26. Apparatus according to claim 25, wherein said separation flow exit opening is disposed below the flow connection opening between said last of said separation chambers and the next adjacent chamber thereto.

27. Apparatus according to claim 1, wherein said separation flow entrance opening lies above the flow outlet from said first of said separation chambers to the next adjacent separation chamber.

28. Apparatus according to claim 27, wherein said separation flow exit opening is disposed below the flow connection opening between said last of said separation chambers and the next adjacent chamber thereto.

29. Apparatus according to claim 1, wherein said first of said separation chambers is bounded in part by a U-shaped partition wall having an essentially vertical bridge portion joined by shank portions extending at an angle of greater than 90° with respect to said vertical bridge portion.

30. Apparatus according to claim 29, wherein a total of two separation chambers are provided, one above the other, wherein said U-shaped partition wall forms a lateral and upper boundary of said first upper separation chamber as well as part of the lateral boundaries of said other lower separation chamber, and wherein an L-shaped partition wall forms the opposite lateral boundary wall of said upper separation chamber as well as the upper boundary wall of said lower separation chamber, said separation flow exit being formed between the tank housing and the lower extremity of said U-shaped partition wall.

31. Apparatus according to claim 30, wherein the vent connections for said separation chambers have a common boundary wall formed by the vertically extending leg of said L-shaped partition wall.

32. Apparatus according to claim 31, further comprising a vent bypass connection leading from said air chamber means to said main flow chamber in bypassing relationship to said vent means for accommodating escape of entrapped air from the liquid flowing through said main flow chamber.

33. Apparatus according to claim 32, wherein said vent bypass connection is bounded on one side by said vertically extending bridge portion of said U-shaped partition wall.

34. Equalizing tank apparatus for volume equalization and air separation of a liquid heat carrier flowing through a circulatory system, especially for a circulatory system for combustion engine cooling spaces and the like; said tank apparatus comprising:

a tank housing, separation chamber means arranged in said housing with a separation flow entrance leading from a first part of the circulatory system and a separation flow exit leading to a second part of the circulatory system, said separation chamber means being constructed and arranged to form liquid-air separating means, air chamber means arranged above said separation chamber means, separation chamber vent means coupling said air chamber means with said separation chamber means for accommodating escape of entrapped air from the liquid flowing through said separation chamber means to said air chamber means, a main flow chamber arranged in a lower part of said tank housing and separate from said separation chamber means, said main flow chamber having a main flow exit leading to said second part of the circulatory system and a main flow entrance leading into said main flow chamber from said first part of the circulatory system in such a manner that flow through said main flow entrance is separate from the flow through said separation chamber means, and a vent bypass connection leading from said air chamber means to said main flow chamber in bypassing relationship to said vent means for accommodating escape of entrapped air from the liquid flowing through said main flow chamber to said air chamber means.

35. Apparatus according to claim 34, wherein said vent bypass connection opens into said main flow chamber at a position above the level of both said main flow entrance and main flow exit.

36. Apparatus according to claim 35, wherein said separation flow exit opens into said main flow chamber adjacent said main flow entrance.

37. Equalizing tank apparatus for volume equalization and air separation of a liquid heat carrier flowing through a circulating system, especially for a circulatory system for combustion engine cooling spaces and the like; said apparatus comprising:

tank housing means, separation chamber means arranged in said housing means, air chamber means arranged above said separation chamber means, said separation chamber means being constructed and arranged to form liquid-air separating means and including a plurality of separate separation chambers, a first of said separation chambers including an inlet portion coupled with a separation flow entrance leading from the circulatory system and an outlet portion coupled directly with a second of said separation chambers, said outlet portion being constructed and arranged to permit passage therethrough of at least a substantial portion of the flow of liquid through said first of said separation chambers to said second of said separation chambers, and separate vent connections leading from said air chamber means to each of said first and second separation chambers for accommodating escape of entrapped air from the liquid flowing through said first and second separation chambers to said air chamber means.

38. Apparatus according to claim 37, wherein said first separation chamber is disposed above said second separation chamber, and wherein said outlet portion of said first of said separation chambers is disposed at the bottom of said first of said separation chambers.

39. Apparatus according to claim 38, wherein said outlet portions of said first of said separation chambers is constructed and arranged to permit passage therethrough of all liquid flowing through said first of said separation chambers to said second of said separation chambers.

* * * * *

UNITED STATES PATENT OFFICE

CERTIFICATE OF CORRECTION

Patent No. 4,002,442 Dated January 11, 1977

Inventor(s) Josef Merz

It is certified that error appears in the above-identified patent and that said Letters Patent are hereby corrected as shown below:

Between lines [21] and [52], insert the following:

[30] Foreign Application Priority Data

April 22, 1974 Germany.....2419266.3

Signed and Sealed this

Twenty-first Day of June 1977

[SEAL]

*Attest:*

RUTH C. MASON
*Attesting Officer*

C. MARSHALL DANN
*Commissioner of Patents and Trademarks*